US007214001B2

(12) United States Patent
Casters

(10) Patent No.: US 7,214,001 B2
(45) Date of Patent: May 8, 2007

(54) METHOD AND MACHINE FOR FORMING A CONCRETE PATH

(75) Inventor: François Joseph Casters, Opglabbeek (BE)

(73) Assignee: Drion Constructie, besloten vennootschap met beperkte aansprakeliikheid, Opglabbeek (BE)

( * ) Notice: Subject to any disclaimer, the term of this patent is extended or adjusted under 35 U.S.C. 154(b) by 99 days.

(21) Appl. No.: 11/078,315

(22) Filed: Apr. 21, 2005

(65) Prior Publication Data

US 2006/0104717 A1 May 18, 2006

Related U.S. Application Data

(63) Continuation-in-part of application No. 10/216,848, filed on Aug. 13, 2002, now Pat. No. 7,037,035.

(30) Foreign Application Priority Data

Aug. 31, 2001 (BE) ..... 2001/0543

(51) Int. Cl.
*E01C 23/04* (2006.01)

(52) U.S. Cl. ..... 404/88; 404/100

(58) Field of Classification Search ..... 404/88, 404/100

See application file for complete search history.

(56) References Cited

U.S. PATENT DOCUMENTS 3,274,906 A 9/1966 Worson et al.
3,849,016 A 11/1974 Cochrane et al.
4,312,602 A 1/1982 Dale
4,493,584 A 1/1985 Guntert
4,636,110 A 1/1987 Augoyard
5,209,602 A 5/1993 Godbersen
5,405,242 A 4/1995 Auxier et al.
5,588,776 A 12/1996 Swisher et al.
6,390,727 B1 5/2002 Guntert et al.
6,481,923 B1 11/2002 Casters

FOREIGN PATENT DOCUMENTS

EP 0 518 535 A1 12/1992
FR 2 164 580 8/1973
GB 1415308 10/1972

OTHER PUBLICATIONS

Concrete roads-Development of new techniques; *Highways and Road Construction*, Jun. 1973, p. 13.

*Primary Examiner*—Raymond Addie
(74) *Attorney, Agent, or Firm*—Bacon & Thomas, PLLC

(57) ABSTRACT

An insertion device configured for connecting to a frame of a concrete paving machine. The insertion device including a housing, a guide tube extending from the housing, and an ejection device positioned in the housing and cooperating with the guide tube to individually eject dowels stored by the housing through the guide tube. According to one embodiment, the housing includes an alignment system for aligning the dowels in the housing in a predetermined orientation. In another embodiment, the housing has a parting feature that extends along a forward external side of the housing. In yet another embodiment, the guide tube includes a resilient element provided at an outlet portion that is arranged to seal the outlet portion of the guide tube.

5 Claims, 7 Drawing Sheets

METHOD AND MACHINE FOR FORMING A CONCRETE PATH

CROSS REFERENCE TO RELATED APPLICATION

This application is a continuation-in-part application of U.S. patent application Ser. No. 10/216,848 filed on Aug. 13, 2002 now U.S. Pat. No. 7,037,035.

BACKGROUND

It is known to provide so-called dowels in concrete paths, usually mostly at the location of joints, more particularly so-called load transfer joints, expansion joints or contraction joints. Such dowels are reinforcement bars with a length of approximately 0.5 m, which mostly are provided in the concrete in the longitudinal direction of the path to be formed. Contrary to traditional reinforcement bars, they mostly consist of smooth-surfaced bars used to form a load-transfer joint of expansion or contraction type. Classically, a whole series of such dowels next to each other is provided at mutual interspaces of, for example, 20 to 50 cm. After having provided the dowels in the concrete path and after the concrete possibly already has hardened, over each series of dowels, in the width of the concrete path, up to just above the dowels, a groove is formed, for example, cut, in the concrete, in order to form the expansion joint. With a possible expansion or contraction, the lower part then forms a breaking zone, whereas the dowels still form a connection between both concrete parts, limiting any vertical movement of the concrete, e.g. caused by load applied by the traffic.

According to a known technique, an example of which is known from U.S. Pat. No. 5,405,212, such dowels are provided in the concrete after having formed the concrete path, when the concrete still is wet. To this aim, a series of dowels is dropped in a controlled manner onto the wet concrete surface, after which these dowels subsequently, by means of vibrating forks, are vibrated into the formed concrete path up to a well-defined depth. Usually, this is performed by means of a device situated at the paving machine by which the concrete path is realized, which device, during the insertion of the dowels, temporarily is stopped in respect to the concrete path, whereas the actual paving machine travels on, whereby, after the insertion of the dowels, the respective device is drawn forward.

This known technique has different disadvantages. An important disadvantage consists in that, as the dowels are inserted into the already formed concrete surface, this surface is disturbed, as a result of which an additional finishing operation, mostly by means of a finishing beam also fixed at the paving machine, must be provided for. Even when using such finishing beam, one will note that at the location where the dowels have been inserted, a demixing or so-called segregation of the concrete takes place, resulting in a poor quality of the finally obtained concrete surface.

Another disadvantage of said known technique consists in that such paving machine is relatively long, as a consequence of which it is difficult to turn and difficult to transport, due to the fact that the device must be able to be stopped temporarily for inserting the dowels, whereas the paving machine travels on, and this device, thus, must be movable in the longitudinal direction of the concrete path, over guide elements, as well as due to the fact that an additional finishing beam is required.

Another disadvantage of said known technique consists in that one never knows with certainty whether the dowels are situated on the right place in the concrete, as they may come loose from below the vibrating forks during insertion.

Also, inserting the dowels according to said known technique requires a large power, for commanding and moving the device along the paving machine, as well as for pushing and vibrating the dowels into the concrete.

In order to counteract the demixing of the concrete, it is already known to realize a concrete path in two layers, whereby before providing the second layer, series of dowels are deposited on the first layer. It is, however, obvious that this, due to the fact that a double layer has to be realized, is a complicated technique and/or a technique necessitating the use of rather complicated machines.

SUMMARY

The invention aims at a method and machine with which one or more of said disadvantages can be excluded and according to which a concrete path provided with dowels can be realized in a very efficient manner.

To this aim, according to a first aspect, a method is described for forming a concrete path or the like, which concrete path is provided with dowels, whereby unhardened concrete, by means of at least one form piece moving over the concrete, is brought into the shape of the concrete path to be realized. These dowels are brought into the concrete in front of and/or at the height of the form piece, more particularly before and/or at the moment when the concrete surrounding the dowels is forced, by means of the form piece, into the shape of the concrete path to be realized. In that the dowels in this manner are inserted before the actual concrete surface has been formed, it is excluded that this concrete must be disturbed afterwards. Thus, a demixing of the concrete neither will take place, as a result of which a concrete path with a perfect final quality can be guaranteed.

Of course, in this way there will be no necessity for using a finishing beam, as a consequence of which the construction of the applied machine can be particularly simple. However, this does not exclude that such finishing beam and/or other finishing elements, such as a smoothing board moving to and fro, can be used.

According to one characteristic, the dowels are inserted into the concrete such that, in a longitudinal direction, they are systematically enclosed by the concrete. It follows that the dowels are inserted or injected in a generally horizontal manner in the concrete. Due to this manner of insertion, there is no lateral movement of the dowels through the concrete, which further excludes the occurrence of a certain demixing of the concrete.

According to another characteristic, the concrete is vibrated and the dowels are brought into the concrete at the location where the concrete is vibrated. Thereby, automatically a compacting of the concrete around the dowels is taking place, without any form of demixing occurring.

According to another characteristic, for the insertion of the dowels in the concrete use is made of a device with one or more insertion devices for dowels, and these insertion devices, at least during the periods of time when dowels have to be inserted, are moved, together with the movement of the form piece, through the unhardened concrete which still has to be treated by means of the form piece. In consideration of the fact that the insertion devices substantially are situated in front of the form piece, these elements in fact can be permanently pushed through the rather raw concrete without causing any problem which is contrary to the known dowel apparatuses mounted behind the form piece. According to this inventive characteristic, contrary to the known dowel apparatuses, no additional means are necessary for blocking the insertion means in the longitudinal direction of the concrete path and to draw them back to the paving machine after an insertion cycle.

It is clear that in such case, the insertion devices, at least at their lower ends, are located at a distance from each other, thereby providing passages for the concrete between these elements. An important advantage hereby is that the concrete can be poured in front of the insertion devices, and still better in a traditional manner in front of the complete paving machine. This technique is less critical than in the case that the concrete would be supplied in between the insertion devices and the form piece.

In an embodiment of a paving machine, an insertion device is used for inserting the dowels which comprises several feeding elements provided next to each other at regular interspaces, in order to bring thereby several dowels next to each other into the concrete, and the concrete is vibrated by means of different vibrating elements which are positioned between the respective insertion devices.

According to another embodiment, for the insertion of the dowels in the concrete, at least one insertion device is provided and dowels are pushed out of this insertion device in a longitudinal direction and thereby inserted into the concrete. As a consequence thereof, the dowels are put into the concrete in a particularly uniform manner.

In a practical view, the dowels are inserted by keeping them ready in the insertion devices, in the longitudinal direction of the concrete path, and subsequently, at the moment when they have to be brought into the concrete, releasing them from the insertion devices according to their longitudinal direction. As this takes place according to the longitudinal direction, the surrounding concrete is not disturbed and the risk of demixing is minimized.

Preferably, the dowels are kept ready in a guide tube or centering part and/or sealing part, from where the dowels, through an exit opening, are brought outside one after the other. This centering part and/or sealing part preferably is oblong and slim, such that it is easily enclosed by the concrete and subsequently this concrete connects around the released dowels in an efficient manner.

More particularly, it is preferred that the dowels are expelled by means of a centering part and/or sealing part; that at a location where a dowel has to be inserted, such dowel is kept ready in the centering part and/or sealing part; that a second dowel is provided behind said dowel, in the prolongation thereof; and that during inserting, the first dowel is pushed outside by the movement of the second, after which the second dowel becomes located in the centering part and/or sealing part, ready for a subsequent cycle. This technique offers the advantages that the dowels simply can be brought from the insertion devices to the outside, as well as that no concrete can penetrate into the insertion device, as the place of each inserted dowel immediately is taken by another.

According to another embodiment, the dowels are released from the insertion devices by moving them in a direction of movement in respect to the insertion devices moved through the concrete which is opposed to the direction of movement of the insertion devices, however, with a speed which is equal to, or approximately equal to, the speed of the insertion devices traveling through the concrete. Hereby, it is achieved that the dowels during inserting are standing still in respect to the ambient concrete and that the concrete sets around them. This also contributes to preventing any form of demixing of the concrete.

It is noted that the characteristic, according to which the dowels are inserted at the location where the concrete is vibrated, as well as the characteristic according to which the dowels are inserted such into the concrete that they systematically are surrounded by the concrete in a longitudinal direction, form characteristics which minimize the risk of demixing of the concrete. In addition, they also may be applied apart from the fact whether the dowels are inserted into the concrete at a location in front of the form piece and/or at the height of the form piece.

According to another aspect, a method for forming a concrete path or the like is provided, which concrete path is provided with dowels, wherein unhardened concrete, by means of at least one form piece moving over the concrete, is brought into the shape of the concrete path to be realized, with as a characteristic that the concrete is vibrated and that the dowels are inserted into the concrete at the location where the concrete is vibrated. As the dowels are inserted at the location where the concrete is vibrated, in fact a compacting of the concrete around the dowels is created, without having a demixing occurring, regardless whether the insertion now takes places in front, below or behind the form piece.

According to yet another aspect, a method for forming a concrete path or the like is provided, which concrete path is provided with dowels, wherein unhardened concrete, by means of at least one form piece moving over the concrete, is brought into the shape of the concrete path to be realized, with as a characteristic that the dowels are inserted such into the concrete that, in longitudinal direction, they are systematically surrounded by the concrete.

It is clear that these inventive characteristics can be combined at random, whereby it is obvious that certain combinations may offer additional advantages.

Further, according to another embodiment, a paving machine for forming a concrete path according to the methods described heretofore is provided. Such machine at least comprises a movable frame, to which a form piece for forming the concrete path is attached, as well as a device for inserting dowels, and, has the characteristic that the device for inserting dowels is situated, according to the travel direction of the machine, in front of and/or at the height of the form piece.

It is clear that the invention also relates to an insertion device for inserting dowels which allows to realize the method, as well as a paving machine according to the invention. Of course, such devices may be constructed as units for separate attachment at a paving machine.

It is noted that such device, regardless of the fact whether it fixedly belongs to a certain paving machine or not, can be made modular, as a consequence of which it may easily be adapted to different working widths and/or the interspaces between the dowels situated next to each other may easily be adapted. It is also not excluded to realize the device telescopically adjustable according to the working width, for example, by applying a series of insertion units which are suspended at a telescopic frame and which, in function of the span of the telescopic frame, all systematically are suspended farther or less far from each other, whereby possibly certain units, when suspended too close to each other, can be taken out of operation.

According to an embodiment of the insertion device, the housing includes an alignment system for aligning the dowels in the housing in a predetermined orientation. The alignment system includes a plurality orientation elements disposed on opposed interior sides in the upper portion of the housing that may be arranged in a staggered relationship.

In a variation of this embodiment, the alignment system includes a spring element that is connected to the upper portion of an interior wall of the housing. The spring element may extend into the interior cavity toward the lower portion of the housing so that the spring element prevents a second dowel from dropping onto a first dowel that is located along the lower portion of the housing.

In another variation of this embodiment, a wiping apparatus may be disposed in the lower portion of the housing. The wiping apparatus is arranged for receiving a dowel and permitting transfer of a dowel therefrom through the guide tube by the ejection device.

In yet another variation of this embodiment, a monitoring device may be disposed in the lower portion of the housing. The monitoring device can provide an indication as to the alignment of a dowel within the interior cavity of the housing. The monitoring device may be combined with the wiping apparatus into a single unit whereby the monitoring device is integrated or cooperates with the wiping apparatus.

According to another embodiment of the insertion device, the housing includes a parting feature that extends between the upper and lower portions on a forward external side of the housing. In a variation, the parting feature is defined by a knife edge generally oriented perpendicular to the longitudinal axis of the frame.

In a variation of this embodiment, a nozzle is defined at the lower portion of the housing to provide access from the external side into the internal cavity. A plug may be provided which is configured for insertion in the nozzle. In addition, a forward end of the plug may have a parting feature that is generally oriented perpendicular to the longitudinal axis of the frame.

According to yet another embodiment of the insertion device, the guide tube has an outlet portion that is defined at a first end remote from the housing, and a resilient element is provided at the outlet portion to seal the outlet portion when the guide tube is empty. The resilient element is positioned on the guide tube so that a first end portion of the resilient element extends outwardly from the first end of the guide tube. The resilient element comprises two positions wherein the first position the resilient element surrounds a dowel when the dowel is inserted in the guide tube, and in the second position the first end of the resilient element collapses to seal the outlet portion of the guide tube.

It will be noted that it is envisioned that the insertion device may include each of the aforementioned features individually or in combinations thereof. Thus, it is clearly intended that the insertion device may include the alignment system, parting feature, resilient seal and other features herein described.

BRIEF DESCRIPTION OF THE DRAWINGS

With the intention of better showing the characteristics according to the invention, hereafter, as an example without any limitative character, a preferred form of embodiment is described, with reference to the accompanying drawings, wherein.

DESCRIPTION OF PREFERRED EMBODIMENTS

Figure 1:
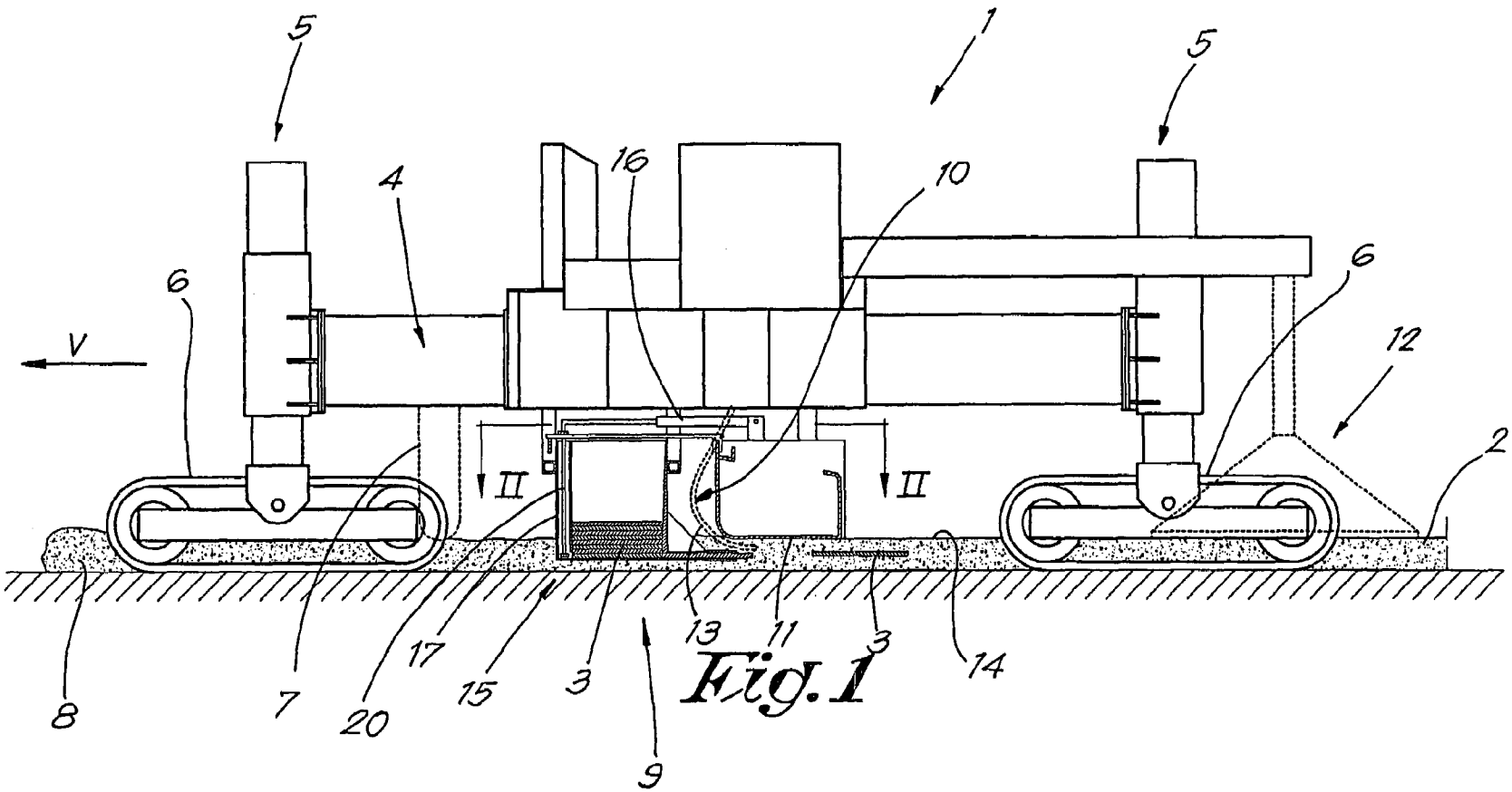
FIG. 1 schematically, in side view and partially in cross-section, represents a paving machine according to the invention.

As represented in FIG. 1, a machine, more particularly a paving machine 1, for forming a concrete path 2 is provided with dowels 3.

The paving machine 1 comprises a frame 4, whether or not extensible in width and/or length, and which is movable by means of support elements 5 situated, for example, at the corner points, which elements are provided, for example, with crawler tracks 6 which can be driven by means of motors which are not represented in the figures.

At the frame 4 and/or at the support elements 5, different tools are attached for realizing the concrete path 2. Depending on the application, either several tools are applied or not. In the example of FIG. 1, these tools consist of, respectively, schematically indicated concrete spreader 7 for spreading concrete 8 poured in front of the paving machine 1, a apparatus 9 for inserting the dowels 3, means 10 for vibrating the concrete, one or more form pieces 11 and a finishing element 12.

The concrete spreader 7 may be of different kind and consist, for example, of a plough for spreading the concrete 8 and/or a driven element, such as a worm screw for distributing the concrete 8.

Figure 2:
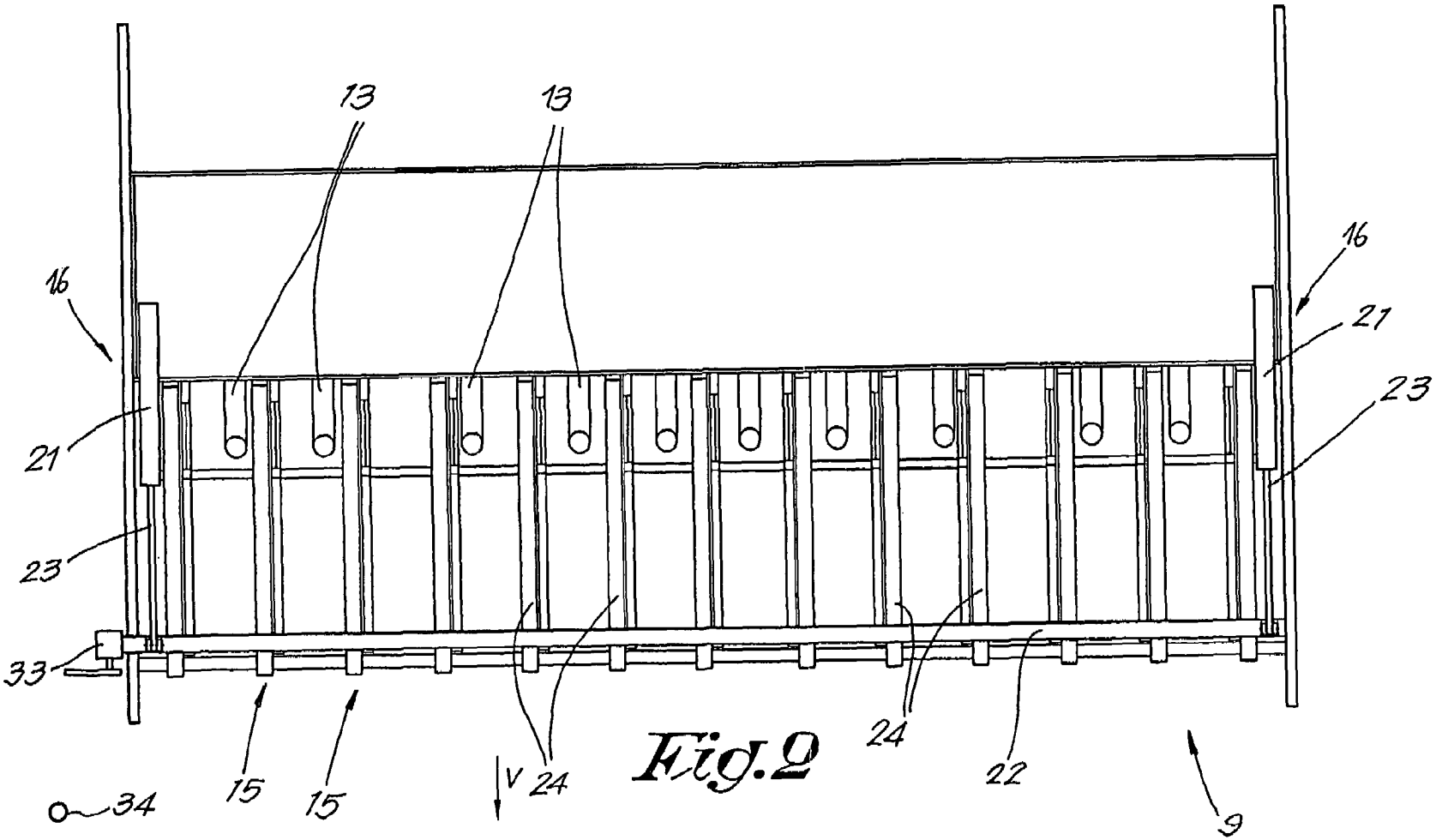
FIG. 2 schematically represents a cross-section according to line II—II in FIG. 1.

As represented in FIGS. 1 and 2, the means 10 for vibrating the concrete preferably consist of a series of internal vibrators in the shape of a needle, further called vibrating elements 13, which, during the treatment of the concrete 8, reach up into the concrete 8, preferably up to below the form piece 11. Such vibrating elements 13 may consist in a known manner of cylindrical elements in which driven excenter weights are provided, the speed of which preferably can be regulated.

The form piece 11 substantially consists of a large mould with which the concrete is pressed into a certain shape and simultaneously is given a smooth surface. When producing a classical concrete path, the form piece is made in a straight manner, for example, as a profile with a cross-section, such as represented in FIG. 1, which extends over the working width. It is clear that it may also have special shapes and may be composed of several parts, for example, for forming a gutter, a standing edge or the like at a concrete path.

The form piece 11 defines a leading edge 36, a forming surface 38 extending towards a trailing end of the frame 4, and a transition point 40 whereat the leading edge 36 merges with the forming surface 38.

The form piece 11 defines a leading edge 36, a forming surface 38 extending towards a trailing end of the frame 4, and a transition point 40 whereat the leading edge 36 merges with the forming surface 38.

Also, several of such form pieces may be applied which can be displaced along each other, such that the working width can be adapted. When in the following, a form piece is mentioned, it is clear that this is also valid for embodiments where several such form pieces are present.

In FIG. 1, the finishing element 12 comprises a smoothing board which can be moved systematically over the formed surface 14 of the concrete path 2.

Of course, the concrete spreader 7 and the finishing element 12 are optional.

According to one embodiment of the paving machine, apparatus 9 for inserting dowels 3, according to the travel direction V of the paving machine 1 during paving, is situated in front of and/or at the height of the form piece 11, contrary to known embodiments whereby the dowel apparatus is mounted behind the form piece.

Such as clearly visible in FIG. 2, the apparatus 9 substantially is composed of, on one hand, a series of insertion devices 15 for inserting dowels 3, positioned adjacent to each other at regular interspaces, and, on the other hand, a drive device 16 cooperating therewith.

The insertion devices 15 are suspended such at the frame 4 that they, during the operation of the machine 1, anyway, at least during the periods of time when dowels 3 have to be brought into the concrete 8, reach up into the concrete 8 situated in front of the form piece 11, more particularly are hanging down into the concrete with their undersides.

The insertion devices 15 and the vibrating needles 13 are positioned in an alternating manner adjacent to each other, distributed over the working width, as clearly represented in FIG. 2.

As represented in FIGS. 3 to 8, the insertion devices 15 comprise upwardly directed elements, each with a housing 17 of a small width extending substantially in a vertical plane parallel to the travel direction of the machine 1. Each housing defines upper and lower portions.

These insertion devices 15 each comprise two compartments situated adjacent to each other, on one hand, a first compartment 18 functioning as a magazine and in which dowels 3 can be stacked horizontally one upon the other and, on the other hand, a second compartment 19 forming a passage for a pressing mechanism pertaining to the drive device 16, more particularly a ejection device 20, which ejection device 20 in fact can be considered as a device for horizontal injection of the dowels.

The ejection devices 20 of the respective insertion devices 15, which, in the represented example, comprise vertical rods, are coupled at their upper side to drive elements pertaining to the drive device 16, according to one embodiment, two simultaneously movable pressure cylinders 21, in such a manner that all ejection devices 20 simultaneously can be subjected to a to-and-fro movement S. To this aim, the ejection devices 20 are connected at their upper portion to a transverse profile 22 extending according to the working width of the machine 1, which profile, in its turn, is movable in that it is coupled, as represented in FIGS. 2 to 7, to the piston rods 23, which can be moved in and out, of the pressure cylinders 21. Hereby, the transverse profile 22 can be shifted over guides 24.

At their lower portion, the ejection devices 20 are provided with a laterally directed cam 25, as a result of which they can cooperate, by means of an open connection, more particularly a passage 26, between the two compartments 18–19, with a dowel 3 situated below in the first compartment 18.

It is obvious that instead of two pressure cylinders 21, also other drive devices may be applied, whether or not they are common to the respective insertion devices 15.

To the lower portion of the rear wall 28 of each compartment 18, next to the bottom thereof, a guide tube 28 is connected which consists of a relatively slim element, with a through-channel 29 which, on one hand, gives out in the magazine for the dowels 3 and, on the other hand, at its free portion, forms an outlet opening 30 for the dowels 3. This guide tube 28 extends parallel to the movement direction of the paving machine 1 and usually is situated such that the outlet opening 20, viewed according to the thickness of the concrete path 2 to be realized, is situated approximately in the middle thereof, as well as it is situated below the front half of the form piece 11, and still more particularly, at the height of the extremities of the vibrating elements 13.

Figure 9:
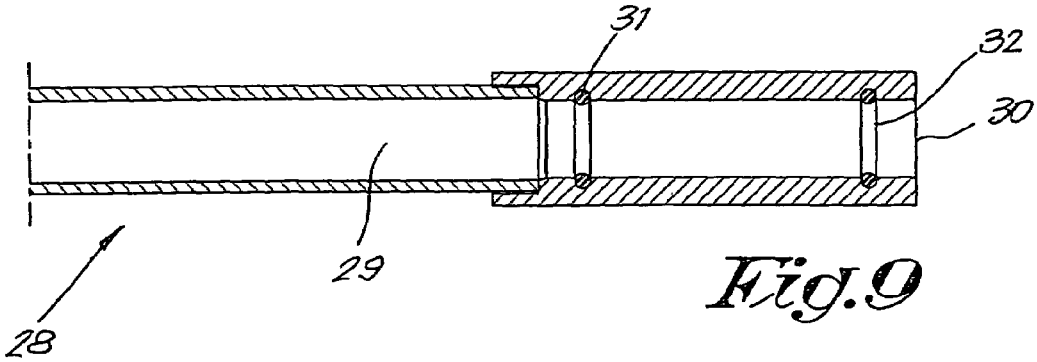
FIG. 9, at a larger scale, represents the part indicated by arrow F9 in FIG. 4.
Figure 12:
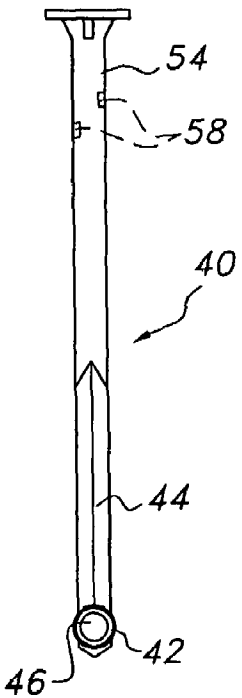
FIG. 12 shows an elevational rear view of the insertion device of FIG. 10.
Figure 10:
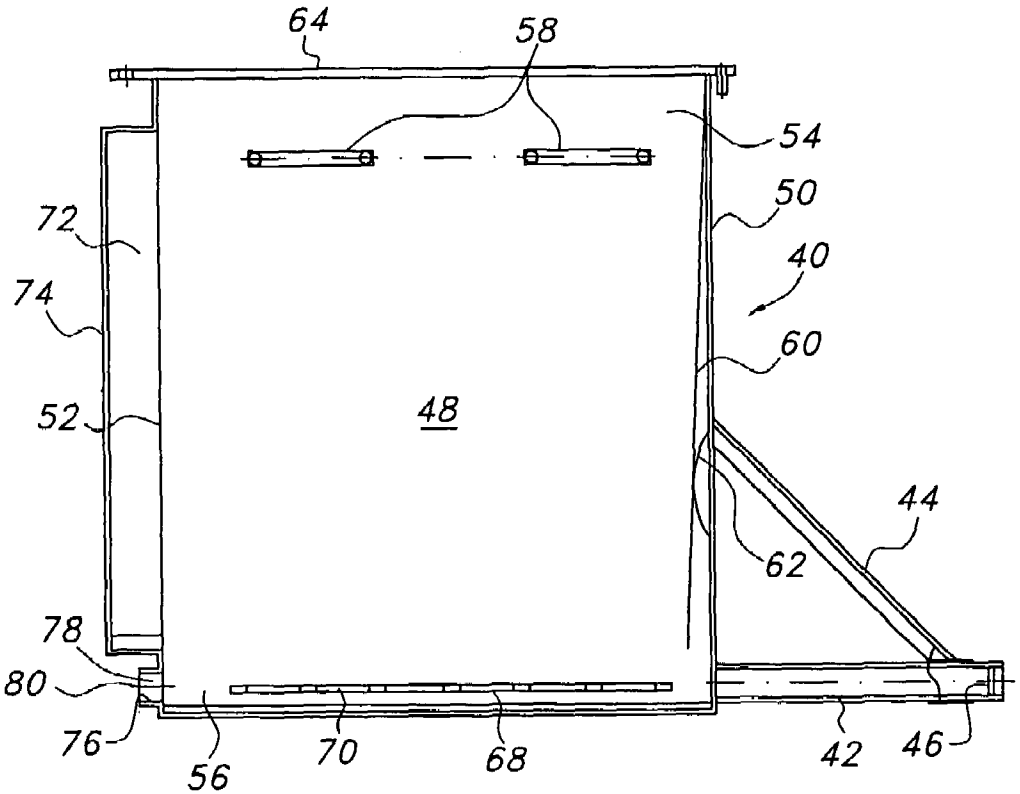
FIG. 10 shows an elevational side view of an embodiment of an insertion device.
Figure 11:
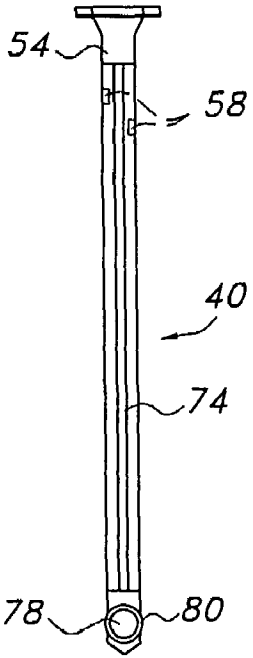
FIG. 11 shows an elevational frontal view of the insertion device of FIG. 10.
Figure 13:
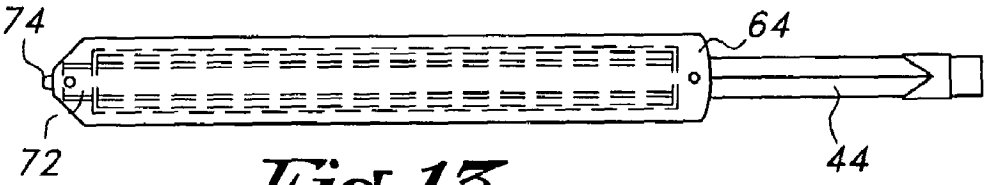
FIG. 13 shows a top view of the insertion device of FIG. 10.

As represented in greater detail in FIG. 9, the guide tube 28 preferably consists of an exchangeable sleeve in which two support points for the centered holding of the dowels 3, in the form of sealing rings 31–32, are provided. Due to the exchangeability, it is possible to provide sleeves for dowels 3 of different diameters and/or lengths.

The guide tube 28 preferably extends with such a length behind the rear wall 27 that, during the presence of one dowel 3 in this part 28, still a second dowel 3 from of compartment 18 can be positioned therebehind.

Further, the apparatus 9 is equipped with a detection device 33 which can cooperate with guide elements 34, erected next to the paving path, for example, small posts provided especially to this aim, and thereby it can activate the drive device 16.

The functioning of the paving machine 1, and more particularly of the apparatus 9, can easily be deduced from the figures and substantially is such as explained hereafter.

Figure 3:
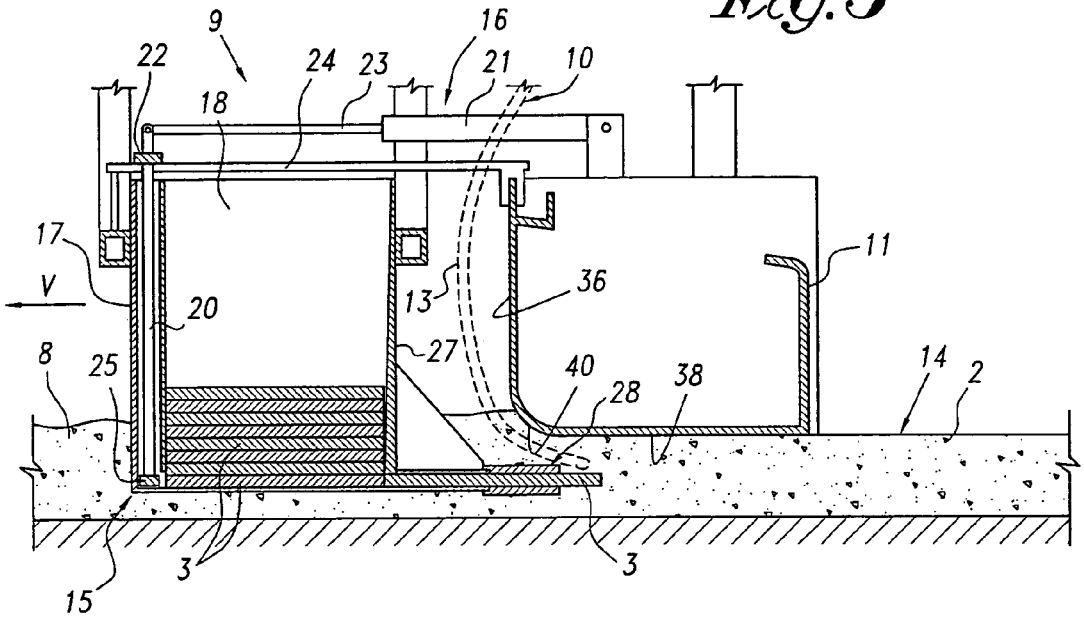
FIGS. 3 to 6, at a larger scale and for different positions, represent the part indicated by arrow F3 in FIG. 1.

First, a sufficient number of dowels 3 is provided in the compartments 18. In rest position, each ejection device 20 is situated with its cam 25 behind the lowermost dowel 3 present in the pertaining magazine. Initially, the pressing elements 20 then are moved once to and fro, by having the piston rods 23 once go in and back out. As a result thereof, a condition ready for an operation cycle is created, as illustrated in FIG. 3, whereby at the bottom, two dowels 3 are situated axially one behind the other, one of which is situated in the guide tube 21, in readiness for being applied.

When forming the concrete path 2, concrete 8 is poured in front of the paving machine 1. This concrete 8 first is roughly spread by said concrete spreader 7, after which, by means of the form piece 11, the actual concrete path 2 is formed. An additional smoothing movement may be performed by means of the finishing element 12.

At the moment when the concrete gets under the form piece 11, it is vibrated by means of the vibrating elements 13, as a result of which is compacted and homogenized.

During paving, the insertion devices 15 are sliding through the concrete 8.

When a series of dowels 3 has to be inserted, this is taking place in the manner as depicted systematically in FIGS. 3 to 6.

To this aim, the pressing elements 20, which originally are in the starting position of FIG. 3, are subjected to a backward displacement S by having the piston rods 23 go in. The activation of the piston rods 23 hereby is, for example, the consequence of a signal delivered by said detection device 33. Of course, such activation also can be commanded manually by applying an appropriate control signal to the pressure cylinders 21.

Figure 4:
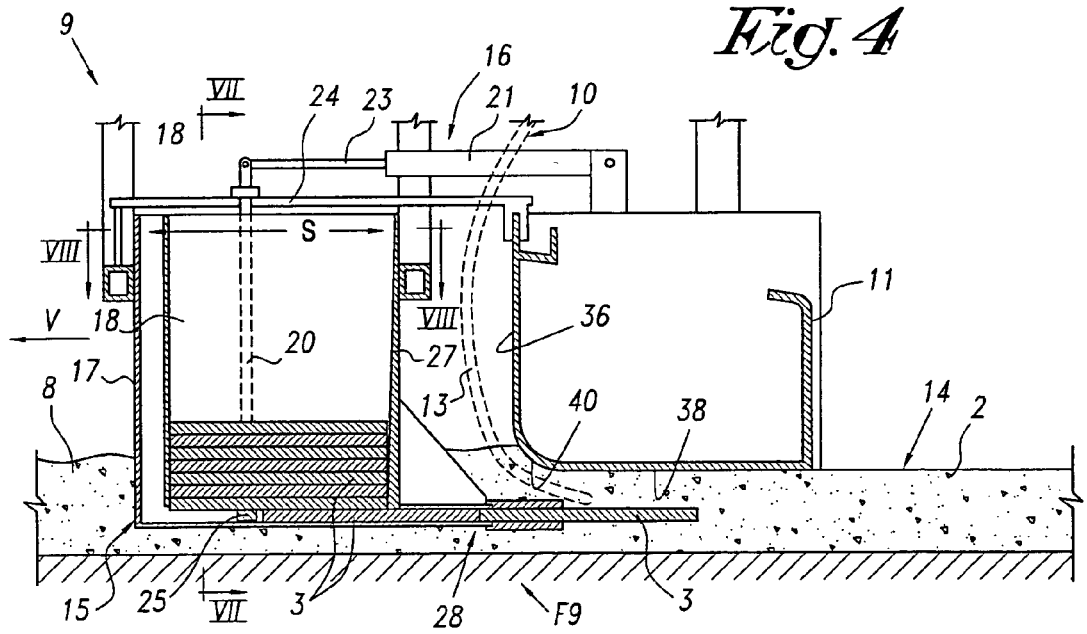

Due to the displacement of the pressing elements 20, first of all a condition is created as in FIG. 4, whereby the lowermost dowel 3 is pushed from the magazine into the guide tube 28, whereas the dowel 3 previously present therein is pushed outward.

The drawing in of the piston rod 23, and more particularly the displacement of the ejection devices 20, is performed at a speed which is equal to the traveling speed of the paving machine 1. On account of the fact that the direction of displacement of the ejection devices 20 in respect to the insertion devices 15, however, is opposed to the travel direction of the paving machine 1, this results in the fact that the dowels 3 which leave the insertion devices 15 are kept at a standstill in respect to the surroundings, whereas the insertion devices 15 move forward and thereby release the respective dowels 3. This speed can be regulated by means of appropriate, not-represented control means.

As a consequence, the dowels 3, being released and inserted into the concrete 8, are, according to their longitudinal direction, systematically surrounded by the concrete, whereby, also as a result of the effect of the vibrating elements 13, a good compacting of the concrete 8 around the dowels 3 is obtained.

Figure 5:
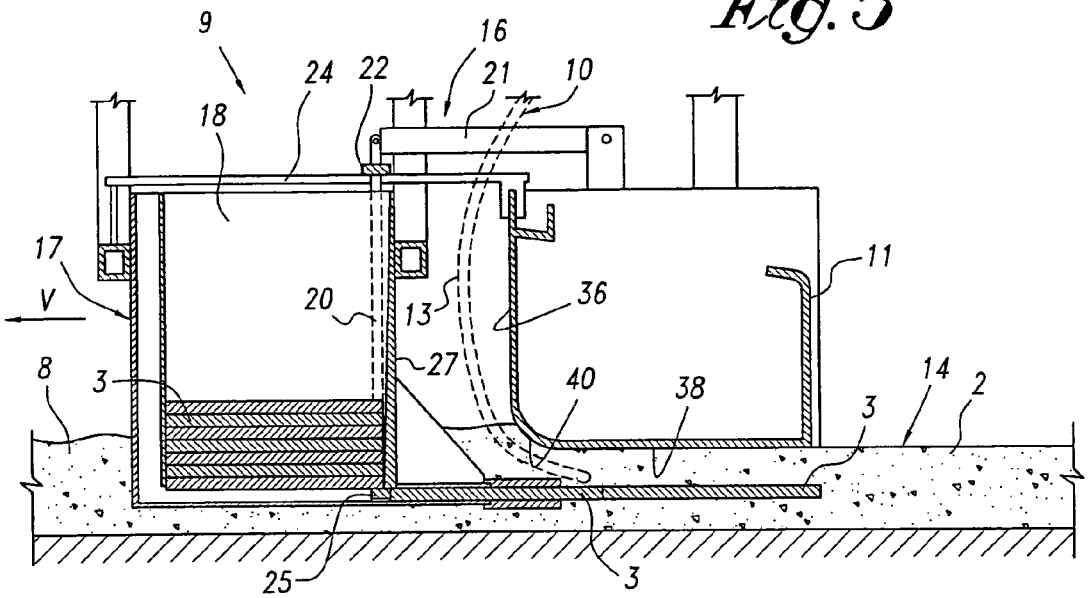
Figure 6:
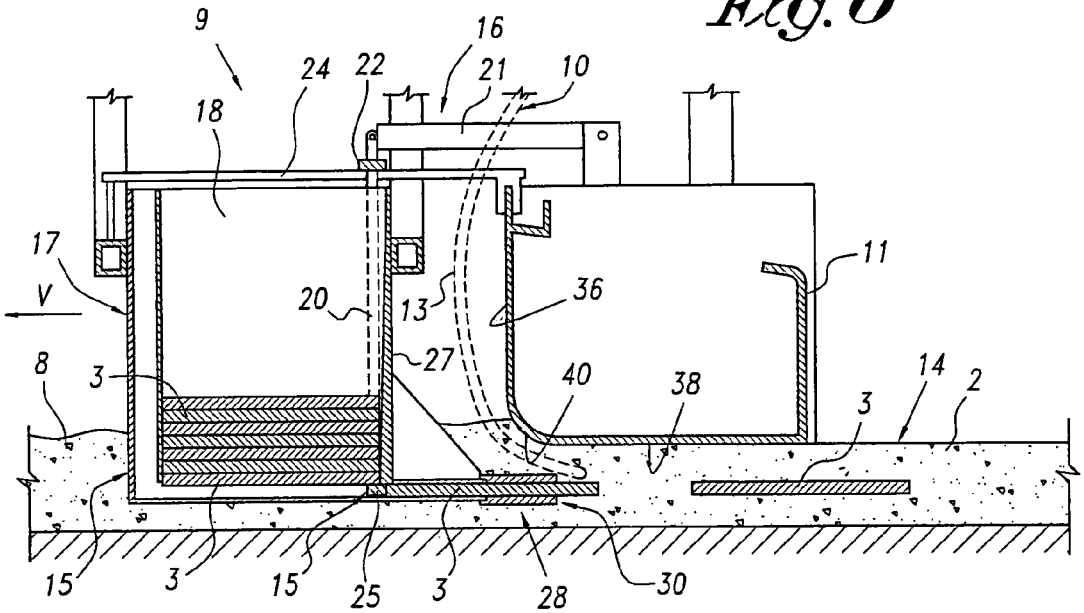
Figure 7:
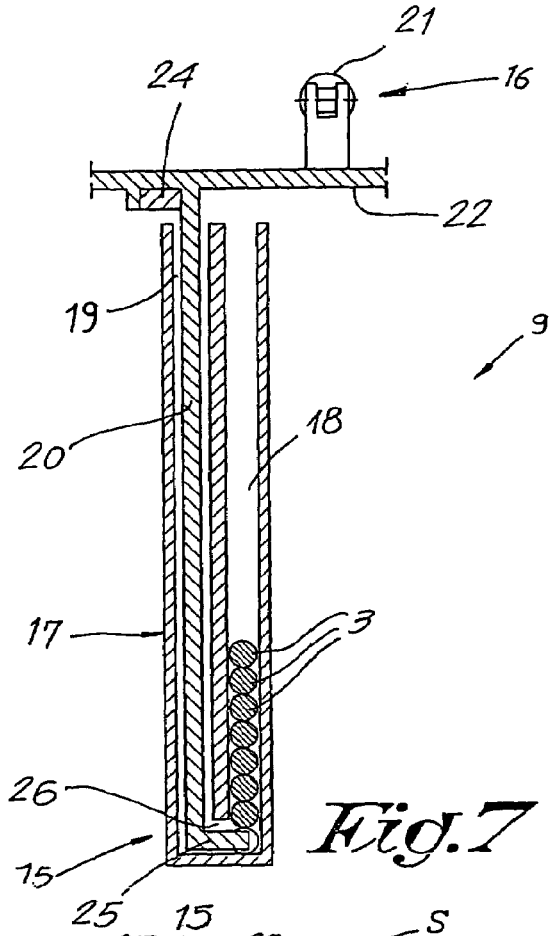
FIGS. 7 and 8 represent cross-sections according to lines VII—VII and VIII—VIII, respectively, in FIG. 4.
Figure 8:
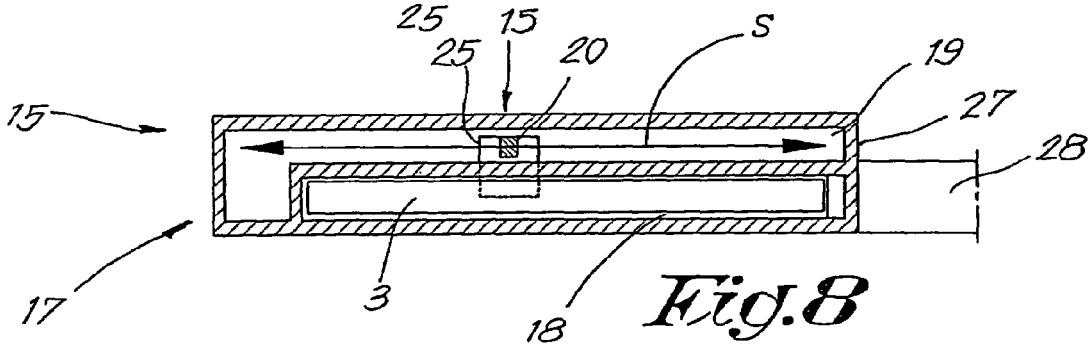

Finally, a condition is created, as depicted in FIG. 5, whereby said second dowel 3 each time becomes located in the guide tube 28, whereas the first dowel 3 is sitting freely in the concrete 8. In consideration of the fact that the paving machine 1 is traveling on, the first dowel, as depicted in FIG. 6, remains in the concrete path 2, whereas the second dowel is carried along in the guide tube 28.

By moving the ejection devices 20 back, again a starting condition, as represented in FIG. 3, is created.

The functioning explained heretofore also illustrates the method described in the introduction.

Of course, different variants are possible. The main idea of the invention consists in that the dowels 3 are brought into the concrete 8 in front of or at the height of the form piece 11, and it is clear that according to the invention, this may be realized in any other manner than described in the aforegoing.

So, for example, this must not necessarily be realized by means of insertion devices 15 which are equipped with magazines for several dowels 3.

It is also possible to provide an automatic supply system for dowels, more particularly for filling the magazines, above the insertion devices 15.

Also, different parts may be made adjustable, exchangeable and/or modular. So, for example, is it possible to apply adaptable side walls in the compartments 18, as a result of which the length and diameter of the compartments 18 can be adjusted in function of the length of the applied dowels 3. Also the depth at which the insertion devices 15 are hanging in the concrete 8, as well as the location where these insertion devices 15 are attached in the width of machine 1, can be adjustable.

Although the dowels preferably are inserted parallel to the travel direction of the paving machine, it is not excluded to realize this at a slight angle of, for example, 15 degrees. To this end, the insertion devices 15 can be adjusted at an angle.

Due to the fact that the insertion devices 15 are pushed through the concrete, the magazines can be located quite close to the form piece, which offers several advantages, such as a more stable construction. In a preferred embodiment, this distance is less than the maximum length of the dowel bars for which the magazines have been designed.

As illustrated in FIGS. 10–14, the insertion device may include an alternate housing 40 and a guide tube 42 that extends from the housing 40 and is supported, at least in part, by a reinforcing member 44 connected to both a rear side 50 of the housing 40 and the guide tube 42. The guide tube 42 defines an outlet portion 46 that is located at and near an end of the guide tube 42 remote from the rear side 50 of the housing 40.

According to this embodiment, an alignment system is provided for aligning dowel bars contained in the housing in a predetermined orientation. The alignment system includes a plurality orientation elements 58 disposed on opposed interior sides of the housing 40 that are arranged in a staggered relationship in an upper portion 54 of the housing 40.

The orientation elements 58 may be constructed of metallic strips that are secured to the interior walls of the housing and may be coated with appropriate materials that will resist wear of the strips.

The alignment system includes a spring element 60 that is connected to the upper portion 54 of an interior wall of the housing 40. The spring element 60 may extend into an interior cavity 48 of the housing toward a lower portion 56 of the housing 40 so that the spring element 60 can prevent a second dowel bar contained in the interior cavity 48 from being loaded upon a first dowel bar located along the lower portion 56 of the interior cavity 48.

According to this embodiment, a top flange 64 is connected to the upper portion 54 of the housing 40 and the upper portion 54 has a tapered opening 66 that is configured as a funnel for receiving dowel bars.

In addition to the alignment system, a wiping apparatus 68 is mounted in the lower portion 56 of the interior cavity 48. The wiping apparatus 68 is arranged for receiving a dowel bar and permitting transfer of a dowel bar therefrom through the guide tube 42. The wiping apparatus 68 is particularly employed for wiping any dirt or other debris that may be carried by a dowel bar prior to insertion into concrete. By wiping the dowel bars prior to insertion into concrete, dirt or other debris may be removed so as to provide effective deposition of dowel bars through the guide tube and into wet concrete. Any dirt or debris wiped from the dowel bars is intended to collect below the wiping apparatus 68 at the lower portion 56 of the interior cavity 48.

Figure 14:
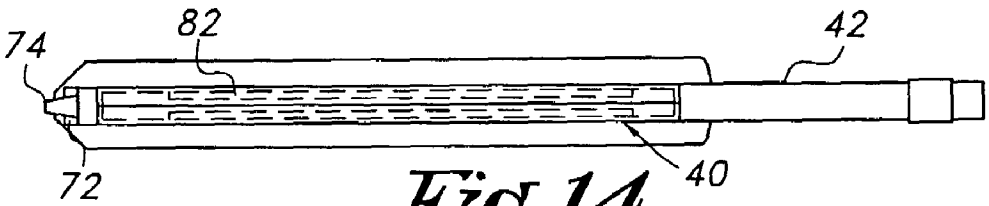
FIG. 14 shows a bottom view of the insertion device of FIG. 10.

According to one variation shown in FIG. 14, the wiping apparatus 68 includes opposed strips are provided on opposed sides of the interior cavity 48 which wipe sides of dowel bars. The wiping apparatus 68 may be constructed of any known material that sufficiently removes dirt and debris from dowels. For example, the wiping apparatus may comprise a plurality of sliding strips constructed of rubber.

A monitoring device 70 is disposed in the lower portion of the interior cavity 48. The monitoring device 70 provides an indication as to the alignment of a dowel within the interior cavity 48, in particular in the lower portion 56. The monitoring device 70 may be combined with the wiping apparatus 68 into a single unit whereby the monitoring device 70 is integrated with and cooperates with wiping apparatus 68.

According to one variation, the monitoring device 70 is an electrical switch that sends a relay to an operator of the paving machine to verify that the dowel bars are in proper placement in the housing 40.

Another feature of this embodiment is that the forward surface 52 of the housing 40 includes a parting feature 72 that extends between the upper and lower portions 54, 56 of the housing 40. In this embodiment, the parting feature 72 is defined by a leading edge 74 that is generally oriented perpendicular the longitudinal axis of the housing 40.

The parting feature 72 is particularly advantageous in that it allows the housing 40 to cut through poured concrete in accordance with the method and description of the paving machine described in FIGS. 1 and 3–6 since less resistance is formed by the forward surface of the housing 40 than with a conventional housing.

A nozzle 76 is defined at the lower portion of the housing 40 to provide access from the external side 52 into the internal cavity 48. A plug 78 is provided which is configured for insertion in the nozzle 76. In addition, a forward end of the plug 78 has a leading edge 80 that is generally oriented parallel to the leading edge 74 of the parting feature 72.

The nozzle 76 facilitates cleaning of the interior cavity 48 of the housing, and the leading edge 80 of the plug 78 serves a function similar to the parting feature 72.

Figure 15:
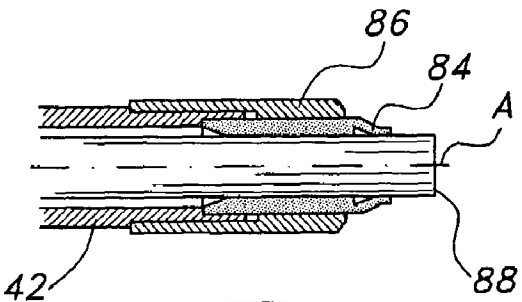
FIG. 15 shows a partial view of an embodiment of the guide tube.

As shown in FIG.15 in yet another feature of the insertion device, the outlet portion 46 of the guide tube 42 includes a resilient element 84 that is provided to seal the outlet portion 46 when the guide tube 42 is without a dowel bar inserted therein.

According to one variation, the resilient element 84 is inserted into a first end of the guide tube 42 and protrudes at least a portion outwardly from the first end of the guide tube 42. A sleeve 86 is secured to an external surface of the guide tube 42 and biases the resilient element 84 inwardly towards a longitudinal axis of the guide tube 42.

The resilient element 84 comprises two positions wherein the first position the resilient element 84 surrounds a dowel bar 88 inserted in the guide tube 42. In the second position (not shown), the resilient element collapses about longitudinal axis A of the guide tube 42 to seal the outlet portion 46.

The resilient element 84 assists in sealing the first end of the guide tube 42, whether or not a dowel bar is loaded in the guide tube 42.

It will be noted that it is envisioned that the insertion device may include each of the aforementioned features individually or in combinations thereof. Thus, it is clearly intended that the insertion device may have at least one of the aforementioned features.

The present invention is in no way limited to the forms of embodiment described by way of example and represented in the figures, on the contrary may such method and machine for forming a concrete path or the like, as well as the device for inserting the dowels used therewith, be realized according to various variants without leaving the scope of the invention.

What is claimed is:

1. An insertion device configured for connecting to a frame of a concrete paving machine, comprising:

a housing defining upper and lower portions and having an interior cavity arranged to contain a plurality of dowels, the housing including an alignment system for aligning the dowels in the housing in a predetermined orientation;

a guide tube extending from the lower end portion of the housing; and an ejection device positioned in the housing and cooperating with the guide tube to individually eject dowels stored by the housing through the guide tube;

wherein the alignment system includes a plurality orientation elements disposed on opposed interior sides of the housing, the orientation elements arranged in a staggered relationship.

2. The insertion device according to claim 1, further comprising a spring element connected to an interior wall of the housing, the spring element extending into the interior cavity toward the lower portion of the housing.

3. The insertion device according to claim 1, further comprising a wiping apparatus disposed in the lower portion of the interior cavity of the housing and arranged for receiving a dowel and permitting transfer of a dowel therefrom through the guide tube by the ejection device.

4. The insertion device according to claim 1, further comprising a monitoring device disposed in the lower portion of the interior cavity, the monitoring device providing an indication as to the alignment of a dowel within the interior cavity of the housing.

5. The insertion device according to claim 3, further comprising a monitoring device disposed in the lower portion of the interior cavity and cooperating with the wiping apparatus, the monitoring device providing an indication as to the alignment of a dowel within the interior cavity of the housing.

* * * * *

UNITED STATES PATENT AND TRADEMARK OFFICE

CERTIFICATE OF CORRECTION

PATENT NO. : 7,214,001 B2
APPLICATION NO. : 11/078315
DATED : May 8, 2007
INVENTOR(S) : Francois Joseph Casters It is certified that error appears in the above-identified patent and that said Letters Patent is hereby corrected as shown below:

On The Title Page, Item -73- should read,

Assignee: Drion Constructie, besloten vennootschap met beperkte ~~aansprakeliikheid~~ aansprakelijkheid Signed and Sealed this Twenty-third Day of October, 2007

JON W. DUDAS
*Director of the United States Patent and Trademark Office*